United States Patent [19]

Tomcavage

[11] 4,456,851

[45] Jun. 26, 1984

[54] ELECTRON TUBE HAVING A LOW IMPEDANCE REDUCED STRESS ANODE STRUCTURE

[75] Inventor: Joseph R. Tomcavage, Lancaster, Pa.

[73] Assignee: RCA Corporation, New York, N.Y.

[21] Appl. No.: 363,298

[22] Filed: Mar. 29, 1982

[51] Int. Cl.[3] ..... H01J 1/88; H01J 19/42

[52] U.S. Cl. ..... 313/250; 313/247; 313/293

[58] Field of Search ..... 313/250, 293, 257, 246, 313/247

[56] References Cited

U.S. PATENT DOCUMENTS

| | | | |
|---|---|---|---|
| 2,819,421 | 1/1958 | Ringland et al. | 313/250 X |
| 3,177,392 | 4/1965 | Free | 313/250 |
| 3,319,108 | 5/1967 | Smith | 313/250 X |
| 3,327,156 | 6/1967 | Gerlach | 313/250 |
| 3,351,800 | 11/1967 | Beggs | 313/250 X |
| 3,405,299 | 10/1968 | Hall et al. | 313/250 X |
| 4,295,077 | 10/1981 | Carter et al. | 313/293 |

*Primary Examiner*—Saxfield Chatmon

*Attorney, Agent, or Firm*—Eugene M. Whitacre; Dennis H. Irlbeck; Vincent J. Coughlin, Jr.

[57] ABSTRACT

An electron tube comprises an evacuated envelope including an anode forming a section of the envelope and a plurality of alternatively-disposed metallic and insulating annular members. The anode includes an anode ring having a plurality of slots formed therein to provide stress reduction. The anode ring is attached to one of the metallic members thereby providing a low impedance electrical interconnection therebetween.

7 Claims, 3 Drawing Figures

ELECTRON TUBE HAVING A LOW IMPEDANCE REDUCED STRESS ANODE STRUCTURE

BACKGROUND OF THE INVENTION

The present invention relates to electron tubes, and particularly to a high power electron tube for use in VHF and UHF operation. The envelope of the electron tube includes both metallic and insulating rings sealingly interconnected with one another. The metallic rings serve as lead-out conductors for electrically connecting the electrodes inside the tube envelope to external terminals. An improved anode structure forms a portion of the tube envelope.

U.S. Pat. No. 3,327,156 to Gerlach issued on June 20, 1967 describes a high power electron tube of ceramic-metal construction that utilizes a compressible annular contact member in the form of helically-wound wire disposed between the anode of the tube and the end surface of an adjacent conductive annular ring that comprises a section of the tube envelope. The disclosed structure provides a means of manufacturing electron tubes in a plurality of subassemblies without extensive welding, soldering or brazing. The helically-wound wire provides both a highly conductive electrical path between the anode and the adjacent conductive annular ring as well as a means of reducing the effect of differential expansion between the anode and the ceramic elements of the tube envelope. The structure described in the Gerlach patent is an improvement over the prior art electron tube structures which are assembled by means of peripheral welded or brazed seams between adjacent conductive members. In such prior art structures, alternating currents tend to flow near the outermost surfaces of the metal parts throughout the major portions of the paths from the internal electrodes to the external tube terminals and introduce high resistance into the tube connections with the external circuitry. Such a tendency is known as skin effect. The high resistance connections may be detrimental to proper operation of the tube. While the helically-wound wire contact member disclosed in the Gerlach patent provides advantages over conventional prior art tube interconnections, the helically-wound wire contact member tends to fatigue after a period of time due to mechanical and thermal effects and the electrical contact between the anode and the adjacent conductive ring deteriorates. As a result, an intermittent decrease in the power output of the tube occurs. Additionally, internal arcing across the contact member may occur resulting in a localized increase in tube temperature and a failure of a ceramic element. Such a failure requires the replacement of the tube.

U.S. Pat. No. 3,287,597 to Smith, issued on Nov. 22, 1966 shows a tube structure in which the wall thickness of the copper anode is reduced at the sealing edge to withstand the forces caused by the different expansion characteristics of the copper anode and the ceramic portion of the envelope wall. The reduced thickness anode wall forms a sealing ring which comprises a portion of the vacuum envelope. The sealing ring of the Smith structure must be thick enough to maintain the vacuum integrity of the envelope and high enough to provide the flexibility required to withstand the expansion difference between the anode and the ceramic.

SUMMARY OF THE INVENTION

An electron tube comprises an evacuated envelope including an anode forming a section of the envelope and a plurality of alternately-disposed metallic and insulating annular members. The anode includes an anode ring having stress reduction means formed therein. The anode ring is attached to one of the metallic members thereby providing a low impedance electrical interconnection therebetween.

DETAILED DESCRIPTION OF THE PREFERRED EMBODIMENT

Figure 1:
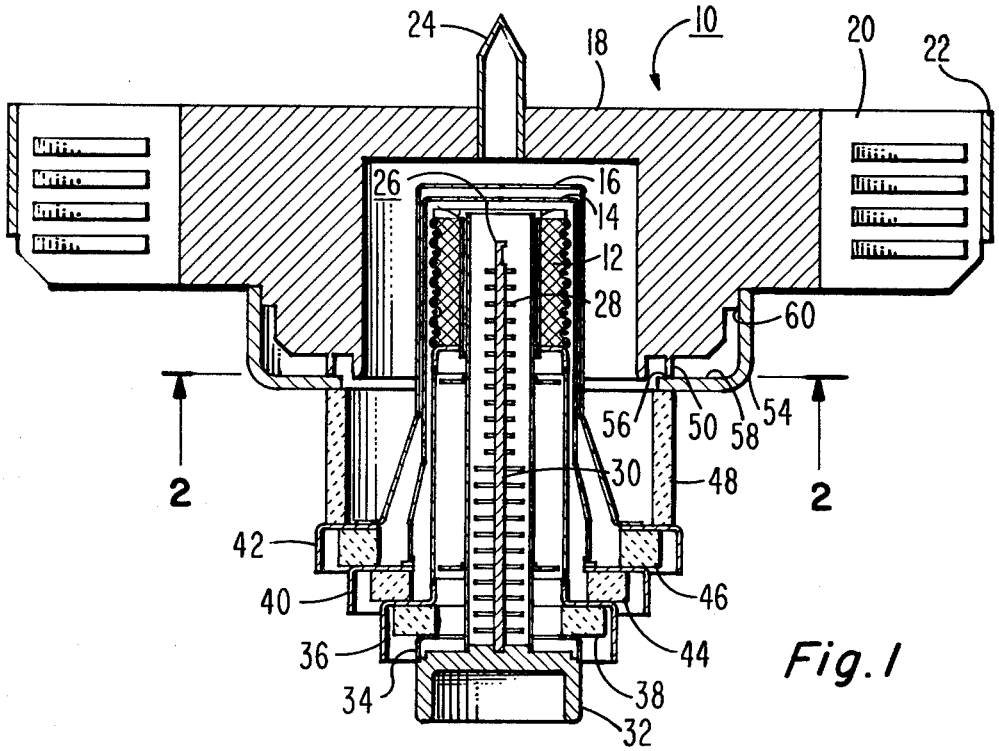
FIG. 1 is a longitudinal cross-sectional view of a high power electron tube employing the present anode structure.

Referring to FIG. 1, there is shown an evacuated high power electron tube 10 suitable for use in VHF and UHF service. The tube 10 is shown to comprise a nested cylindrical cathode, control grid, screen grid and anode electrodes 12, 14, 16 and 18, respectively. The anode 18 comprises a copper cylindrical cup member having a substantially closed top end and an open bottom end. An array of radiator fins 20 adapted to be positioned in a stream of air or other cooling fluid encircle the anode. Extending around the exterior edge of the radiator fin array is a cylindrical sleeve 22. An exhaust tubulation 24 extends from the top center of the anode 18.

Disposed within the cathode 12 is a getter assembly 26. The getter assembly 26 includes a plurality of discrete sorption-type getter elements 28 which are attached to a getter support 30.

The electron tube 10 is closed at its base by a flange cup base plate 32. The base plate 32 supports the getter assembly 26 concentrically within the cathode 12. Electrical connection to the cathode 12 is provided by a pair of radially flanged conductive members 34 and 36 which are insulatively mounted to the opposite flat sides of a first annular ceramic insulator member 38. The flanged portion of the conductive member 34 is attached to the base plate 32. The control grid 14 and the screen grid 16 also comprise nested, cup-shaped cylindrical members mounted at their open ends to frustoconical supports which are provided with radially-extending flanges 40 and 42, respectively. A flat second annular ceramic member 44 is insulatively mounted between the conductive member 36 and the control grid flange 40, and a flat third annular ceramic member 46 is insulatively mounted between the control grid flange 40 and the screen grid flange 42. Each of the flanges 32, 36, 40, and 42 includes a downwardly-projecting skirt portion for connecting the respective tube elements with external circuitry (not shown). A cylindrical anode ceramic insulator 48 is disposed between the screen grid flange 42 and the anode 18. The tube structure herein described is conventional and is similar to the structure described in U.S. Pat. No. 2,950,411 to Nekut et al., issued on Aug. 23, 1960, and in U.S. Pat. No. 2,951,172 to Griffiths, Jr., et al., issued on Aug. 30, 1960. The Nekut et al. patent and the Griffiths, Jr., et al. patent are incorporated herein for the purpose of disclosure.

Figure 2:
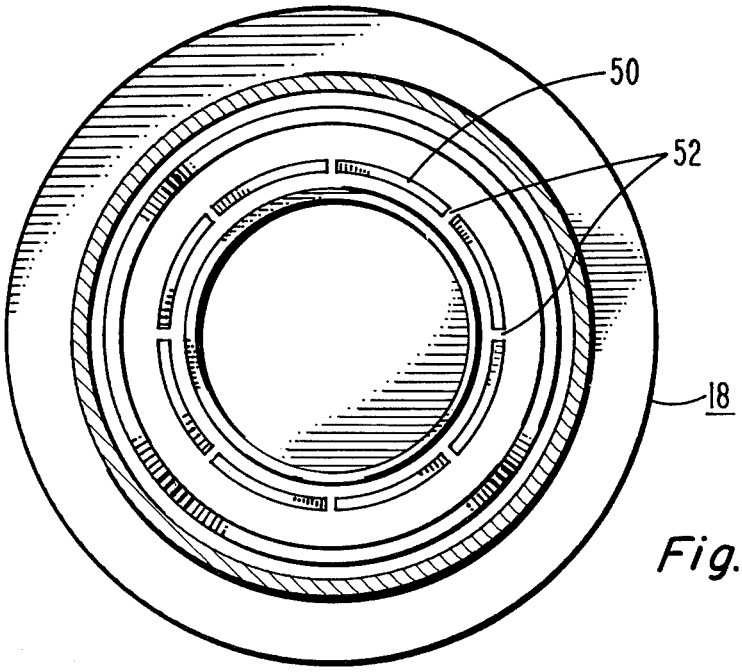
FIG. 2 is a view along line 2—2 of FIG. 1.

In order to minimize the effects of differential expansion between the copper anode 18 and the anode insulator 48, a relatively thin anode ring 50 is formed, e.g., by machining the bottom end of the anode 18. The anode ring 50, shown in FIGS. 1 and 2, has a thickness of about 0.43 mm, an inside radius of about 33 mm and a height of about 1.9 mm. The relation between ring height, h, inside radius, r, and thickness, t, is expressed by the formula $H=0.5(rt)^{\frac{1}{2}}$. A plurality of slots 52 having a width of about 0.76 mm are formed in the anode ring 50. Preferably, about 16 slots are equally spaced around the ring 50. However, the number of slots 52 is dictated by the circumference and thickness of the anode ring and a greater or lesser number of slots may be used. The slots 52 segment the ring 50 into a plurality of flexible sections. The slotted anode ring 50 provides a greater amount of flexibility and stress reduction during tube operation than a nonslotted anode ring such as that disclosed in the above-described Smith patent. It has been determined that the slotted ring 50 permits a reduction in ring height of about 5.1 mm for rings of equivalent thickness. Thus, a tube having a slotted anode ring can be shorted in height and operate at a higher frequency than a tube without a slotted anode ring. U.S. Pat. No. 2,879,428 to Williams, issued on Mar. 24, 1959, discloses an electron tube having notches formed in the lower end of the anode. The notches provide a passageway to prevent a pressure differential from existing in a small space between the flanges connecting the anode to the tube that would otherwise not be evacuated during the manufacturing of the tube. Similarly, U.S. Pat. No. 2,939,988 to Culbertson et al. discloses an electron tube having channels formed in the lower end of the anode for the same purpose. In both the Williams and the Culbertson et al. structures, the portion of the anode between the notches is not attached to the adjacent tube element, therefore, skin effect causes the tube alternating current to follow the outermost surface of the metal parts and to provide a high impedance electrical path.

In Applicant's structure, the anode ring 50 is brazed to a metal flange 54 disposed between the anode insulator 48 and the anode ring 50. A 0.1 mm thick BT braze washer 56 is used between the anode ring 50 and the metal flange 54. By brazing the anode ring 50 to the metal flange 54, a direct, low impedance electrical path is provided between the anode 18 and the flange 54. Thus, Applicant's anode structure provides all the benefits of the above-described Gerlach structure, which utilized the helically-wound wire disposed between the anode and the adjacent conductive ring, without the disadvantages of variations in power output and internal arcing that occurs as the wound wire fatigues with age and use. The metal flange 54, shown in FIG. 1, is preferably L-shaped and comprises a first portion having a substantially flat, radially-extending first sealing surface 58. The anode ring 50 is brazed to the first sealing surface 58. A second portion of the flange 54 includes a second sealing surface 60. The second sealing surface 60 is generally orthogonal to the first sealing surface 58. The second sealing surface 60 of the flange 54 extends coaxially around a portion of the anode 18 and is attached thereto, e.g., by brazing, to complete the vacuum envelope of the tube 10.

Figure 3:
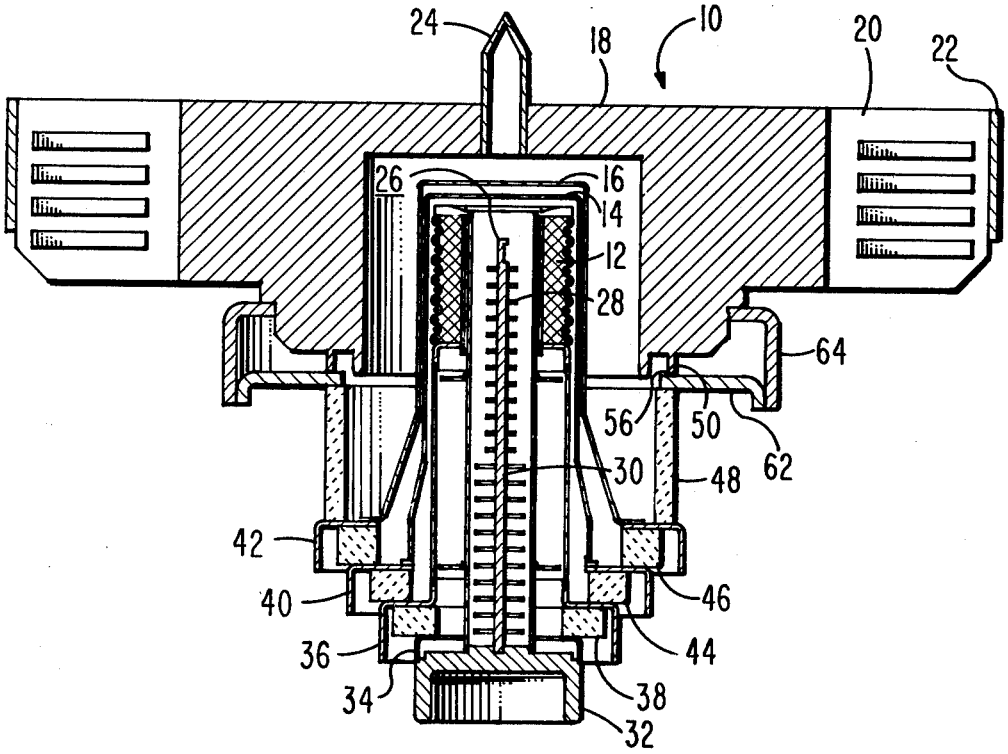
FIG. 3 is a longitudinal cross-sectional view of an alternative high power electron tube employing the present anode structure.

An alternative embodiment of the tube 10 is shown in FIG. 3. Like numbers are used to designate like tube elements. In this embodiment, the novel anode structure is identical to that shown in FIGS. 1 and 2, only the metal flange interconnecting the anode ring 50 and the anode insulator 48 has been changed. In this embodiment, a metal flange 62 having a downwardly-turned skirt is brazed between the anode insulator 48 and the anode ring 50. A second metal flange 64 having a downwardly-turned skirt is brazed to the anode 18 in such a manner as to be coaxially disposed about, and in close proximity to the metal flange 62. The vacuum closure of the envelope is made by sealing, e.g., by brazing or welding together, the ends of the flanges 62 and 64. While the tube 10 described herein is a tetrode, the novel anode ring is not limited to tetrodes and may be used with triodes or any high frequency tube requiring a low impedance, low stress interconnection between the anode and an adjacent metal flange.

What is claimed is:

1. In an electron tube comprising an evacuated envelope including an anode forming a section of said envelope, and a plurality of alternately-disposed annular metallic and insulating members, the improvement wherein said anode comprises an anode ring having stress reduction means formed therein, said anode ring being attached to one of said metallic members, thereby providing a low impedance electrical interconnection between said anode and said metallic member, said anode ring having a height, h, an inside radius, r, and a thickness, t, related by the formula $h=0.5(rt)^{\frac{1}{2}}$.

2. In a high power electron tube comprising an evacuated envelope including an anode forming a section of said envelope, an annular insulator, and an annular metallic member attached between said insulator and said anode, the improvement wherein said anode comprises an anode ring having a plurality of slots formed therein segmenting said ring into a plurality of flexible sections, each of said sections being attached to said metallic member, thereby providing a flexible, low impedance electrical interconnection between said anode and said metallic member.

3. The electron tube as in claim 2 wherein said slots are equally spaced around said anode ring.

4. The electron tube as in claim 3 wherein said slots have a width of about 0.76 mm.

5. In a high power electron tube comprising an evacuated envelope including an anode forming a section of said envelope, an annular insulator, and an annular metallic member attached between said insulator and said anode, the improvement wherein said anode comprises an anode ring having a plurality of slots formed therein segmenting said ring into a plurality of flexible sections, each of said sections being attached to said metallic member, thereby providing a flexible, low impedance electrical interconnection between said anode and said metallic member, said ring having a height, h, an inside radius, r, and a thickness, t, related by the formula $h=0.5(rt)^{\frac{1}{2}}$.

6. The electron tube as in claim 5 wherein said slots are equally spaced around said anode ring.

7. The electron tube as in claim 6 wherein said slots have a width of about 0.76 mm.

* * * * *